US009889576B2

(12) United States Patent
Szilagyi

(10) Patent No.: US 9,889,576 B2
(45) Date of Patent: Feb. 13, 2018

(54) APPARATUS FOR SLICING ROLLED UP CREPES

(71) Applicant: Imre Ivan Szilagyi, London (GB)

(72) Inventor: Imre Ivan Szilagyi, London (GB)

( * ) Notice: Subject to any disclaimer, the term of this patent is extended or adjusted under 35 U.S.C. 154(b) by 0 days.

(21) Appl. No.: 15/313,597

(22) PCT Filed: Sep. 12, 2014

(86) PCT No.: PCT/IB2014/064475
§ 371 (c)(1),
(2) Date: Nov. 23, 2016

(87) PCT Pub. No.: WO2015/189665
PCT Pub. Date: Dec. 17, 2015

(65) Prior Publication Data

US 2017/0210022 A1 Jul. 27, 2017

(30) Foreign Application Priority Data

Jun. 11, 2014 (GB) ..... 1411457.3

(51) Int. Cl.
*B26D 3/16* (2006.01)
*B26D 1/30* (2006.01)
*B26D 7/02* (2006.01)

(52) U.S. Cl.
CPC ..... *B26D 3/16* (2013.01); *B26D 1/30* (2013.01); *B26D 7/02* (2013.01); *B26D 2210/02* (2013.01)

(58) Field of Classification Search
CPC ... B26D 3/16; B26D 1/30; B26D 7/02; B26D 2210/02
See application file for complete search history.

(56) References Cited

U.S. PATENT DOCUMENTS 486,917 A * 11/1892 Walker ..... B23D 21/08 225/103
D164,693 S * 10/1951 Koons ..... D7/673
2,592,657 A * 4/1952 Cierley ..... A21C 11/106 83/543
3,163,192 A * 12/1964 Lupoli ..... B26D 1/553 99/538
4,599,928 A * 7/1986 Oker ..... B26D 1/553 83/581.1
4,646,602 A * 3/1987 Bleick ..... B26D 1/553 30/117
5,035,056 A * 7/1991 Sheffield ..... B26D 1/553 30/114
5,749,145 A * 5/1998 Baukloh ..... B26D 1/553 30/114
7,249,550 B1 * 7/2007 Thune, Jr. ..... A21C 11/106 30/114
D598,718 S * 8/2009 Bellah ..... D7/666
(Continued)

*Primary Examiner* — Sean Michalski

(57) ABSTRACT

The bite slicer apparatus, an apparatus to slice up a crepe on a paper plate, consists of three main parts the mainboard (1) the knife-unit (9) and the bite-stabilizer (14) consisting of the mainboard (1) has been designed in the shape of a U-profile with the lower handle (7) fitted on one side and the bearings (2) fitted on the opposite side, inside the bearings (2) is situated the axis (3), the knife-unit (9) which is made up of a number of blades (11) swings 125° on the axis (3), the bite-stabilizer (14) which is made up of a number of D-rings (15) swings 160° on the axis (3).

5 Claims, 3 Drawing Sheets

(56) References Cited

U.S. PATENT DOCUMENTS

| | | | | | |
|---|---|---|---|---|---|
| D635,409 | S * | 4/2011 | Coffey | B26D 1/30 | D7/674 |
| D664,013 | S * | 7/2012 | Nguyen | B26D 1/30 | D7/674 |
| 8,448,552 | B2 * | 5/2013 | Hoffman | B26B 29/063 | 30/165 |
| 8,806,759 | B2 * | 8/2014 | Cotter | A47J 17/02 | 30/114 |
| 9,186,806 | B2 * | 11/2015 | Holcomb | B26B 3/04 | |
| 2003/0079350 | A1 * | 5/2003 | Howman | A21C 15/04 | 30/114 |
| 2007/0022611 | A1 * | 2/2007 | Verbiest | A21C 15/04 | 30/114 |
| 2008/0250943 | A1 * | 10/2008 | Malandain | A47J 43/25 | 99/537 |
| 2009/0202694 | A1 * | 8/2009 | Julian | B26D 1/38 | 426/506 |
| 2010/0031830 | A1 * | 2/2010 | Engdahl | B26D 1/553 | 99/538 |
| 2010/0175568 | A1 * | 7/2010 | Fritz-Jung | B26D 1/30 | 99/537 |
| 2012/0297991 | A1 * | 11/2012 | Hueser | B26B 27/002 | 99/547 |
| 2015/0343656 | A1 * | 12/2015 | Repac | B26D 3/18 | 83/167 |
| 2015/0343657 | A1 * | 12/2015 | Repac | B26D 1/30 | 83/549 |
| 2015/0345200 | A1 * | 12/2015 | Repac | E05F 1/1215 | 241/84.3 |
| 2016/0039107 | A1 * | 2/2016 | Varanasi | B26D 3/185 | 83/599 |
| 2016/0214268 | A1 * | 7/2016 | Zaremski | B26D 7/12 | |
| 2016/0302620 | A1 * | 10/2016 | Repac | A47J 43/25 | |
| 2017/0080590 | A1 * | 3/2017 | Maslana | B26D 7/2614 | |

* cited by examiner

APPARATUS FOR SLICING ROLLED UP CREPES

BACKGROUND

The recognition is that the commercially-made crepe, traditionally served up on a paper plate, a paper cone or in any other way, is an inconvenient way to consume this product and reduces its market potential.

I have solved this problem with the bite slicer apparatus, which slices a crepe into crepe bites on a paper plate ready to be served up.

SUMMARY OF THE INVENTION

The invention's aim is to provide a bite slicer apparatus that slices a crepe into bites. In addition, it is simple to use, easy-to-handle and easy-to-clean.

The invention's object, the bite slicer apparatus, consists of three main parts: the mainboard, the knife-unit and the bite-stabilizer.

The mainboard has been designed in the shape of a U-profile with the lower handle fitted on one side and the bearings fitted on the opposite side.

Inside the bearings is situated the axis. The knife-unit, which consists of a number of blades, swings 125° on the axis.

The bite-stabilizer, which consists of a number of D-rings, swings 160° on the axis.

ADVANTAGES

The crepe has been made for commercial purposes and has been traditionally served up on either a paper plate, a paper cone or in any other way. The object of the invention, the bite slicer apparatus, has not been known before. It slices up a crepe simply and quickly.

The crepe gets sliced by a number of blades simultaneously. This results in the crepe filling remaining inside the bites.

A crepe served in this way can be consumed easily, in a civilized manner and increases its market potential.

DRAWINGS

The further attributes and operations of the invention have been described below, where the invention will be reviewed in detail using a specific example. On the subjunctive illustration FIG. 1 The object of the invention, the bite slicer apparatus in closed position in axonometric view FIG. 2 The object of the invention, the bite slicer apparatus in side-view FIG. 3 The object of the invention, the bite slicer apparatus in opened position in axonometric view FIG. 4 The object of the invention, the bite slicer apparatus in front-view FIG. 5 The object of the invention, the bite slicer apparatus in rear-view FIG. 6 The object of the invention, the bite slicer apparatus knife-unit in axonometric view FIG. 7 The object of the invention, the bite slicer apparatus's bite-stabilizer in axonometric view

BRIEF DESCRIPTION OF THE DRAWINGS

On FIG. 1 the object of the invention the bite slicer apparatus can be seen in its closed position shown in axonometric view. The three main parts, mainboard (1) knife-unit (9) and the bite-stabilizer (14) are clearly visible.

The mainboard (1) of the bite slicer apparatus has been designed in the shape of a U-profile with the lower handle (7) fitted on one side and secured with a sleeve (18) fitting and the bearings (2) have been fitted on the opposite side. Inside the bearings (2) is the axis (3) and dome nuts (4) are fitted on both ends of the axis (3).

The bite slicer apparatus' upper handle (13) is secured on the knife-unit's (9) blade connector profile (10) with sleeve fitting (18).

Figure 7:
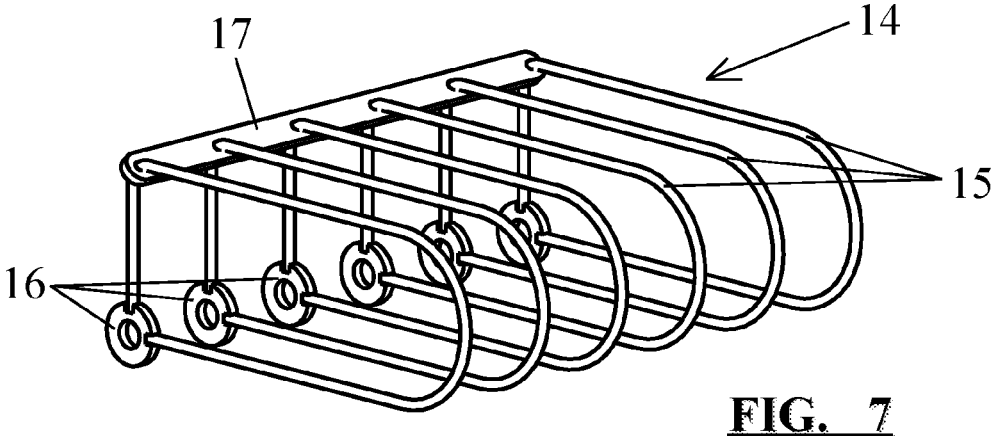

FIG. 7 is represented by the bite-stabilizer (9) independently. It is made up of a number of D-rings (15) alongside each other and set equidistant using the spacer-rings (6) as shown on FIG. 5, on one side with the stabilizer-rings (16) fitted on the axis (3), the other side is connected with the D-ring connector profile (17).

Figure 1:
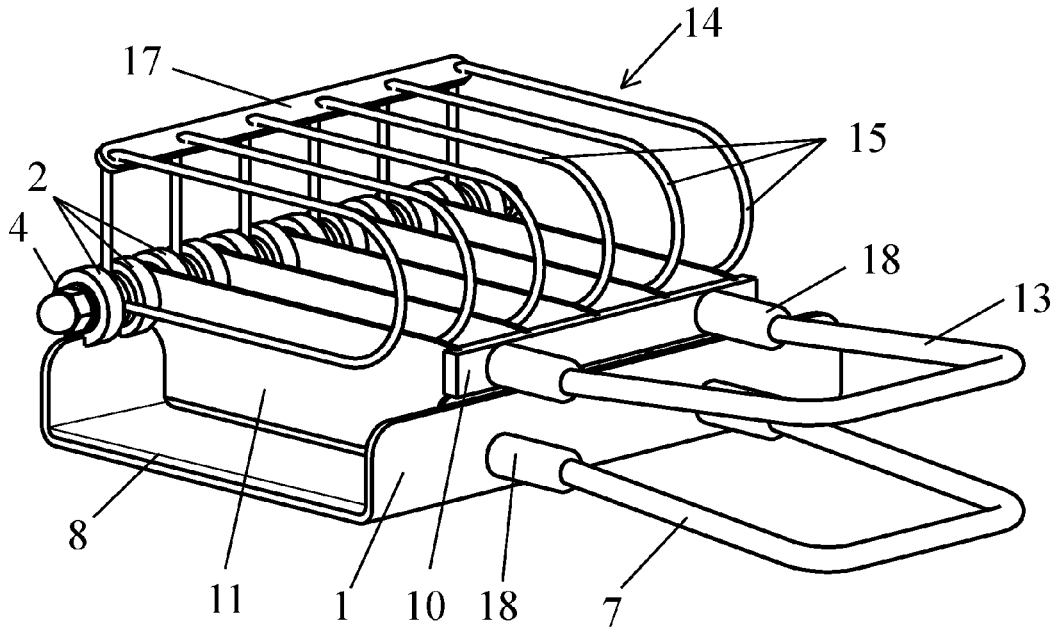
Figure 2:
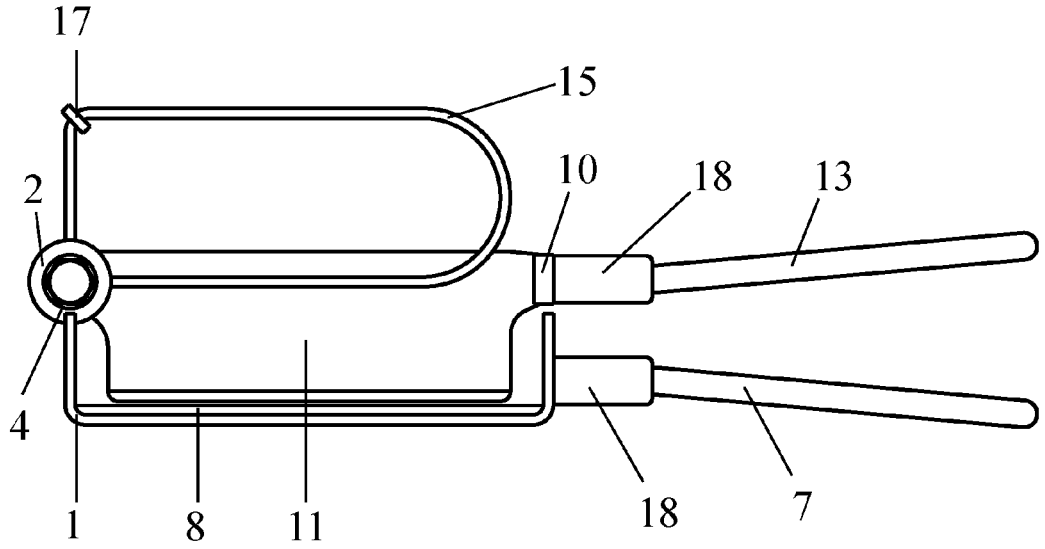
Figure 4:
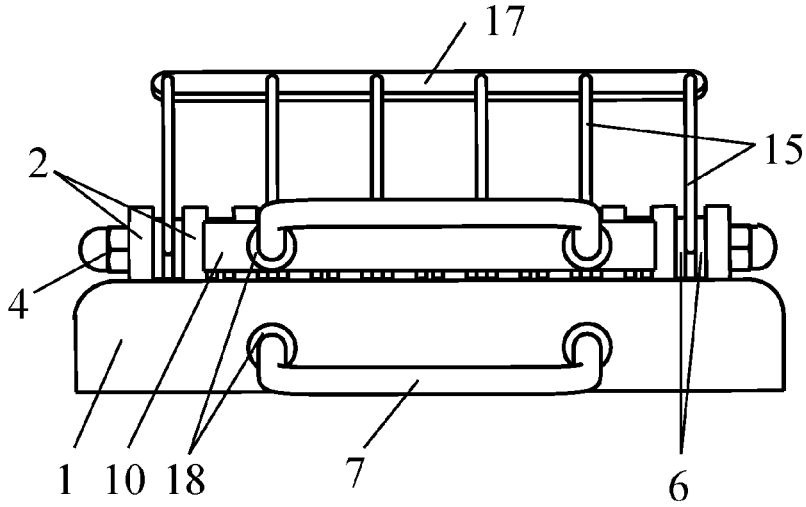

FIG. 2 shows the bite slicer apparatus in side view and FIG. 4 shows the front view of the bite slicer apparatus the knife-unit's (9) closing to the mainboard (1) is beneficially made to leave a practical gap between an exchangeable, unattached silicon sheet (8), which is fitted on the mainboard (1), and the edges of the knife-unit's (9) blades (11).

Figure 5:
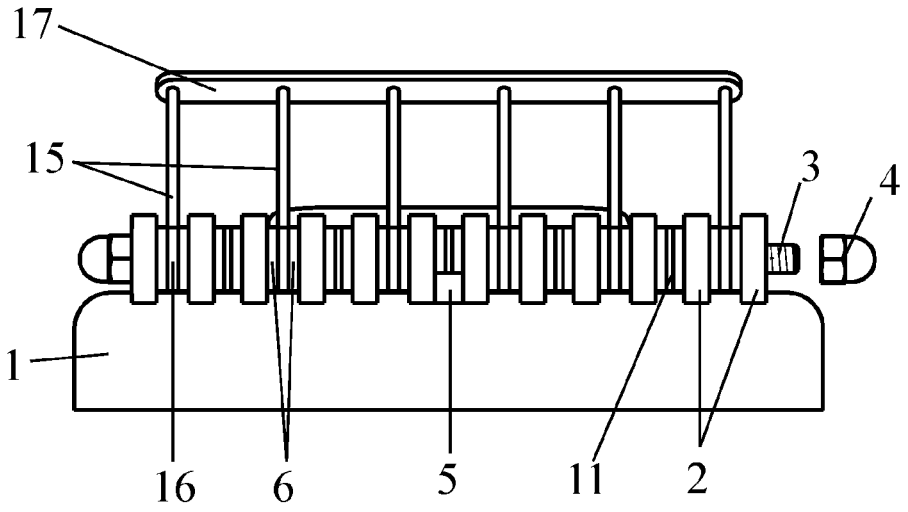
Figure 6:
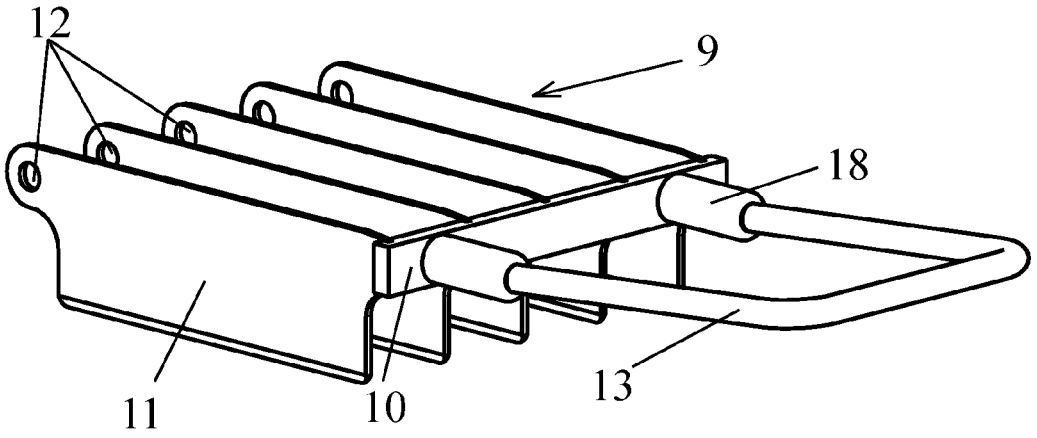
FIG. 6 is represented by the knife-unit (9) independently. It consists of a number of blades (11) alongside each other and set equidistant using the spacer-rings (6) as shown on FIG. 5, on one side and with the blades' boreholes (12) fitted on the axis (3), the other side is connected with the blade connector profile (10).

FIG. 5 shows the rear view of the bite slicer apparatus where a buffer (5) has been built in the middle of the row of bearings (2) and is responsible for stopping the knife-unit (9) at 125°.

The Operation of the Bite Slicer Apparatus

Figure 3:
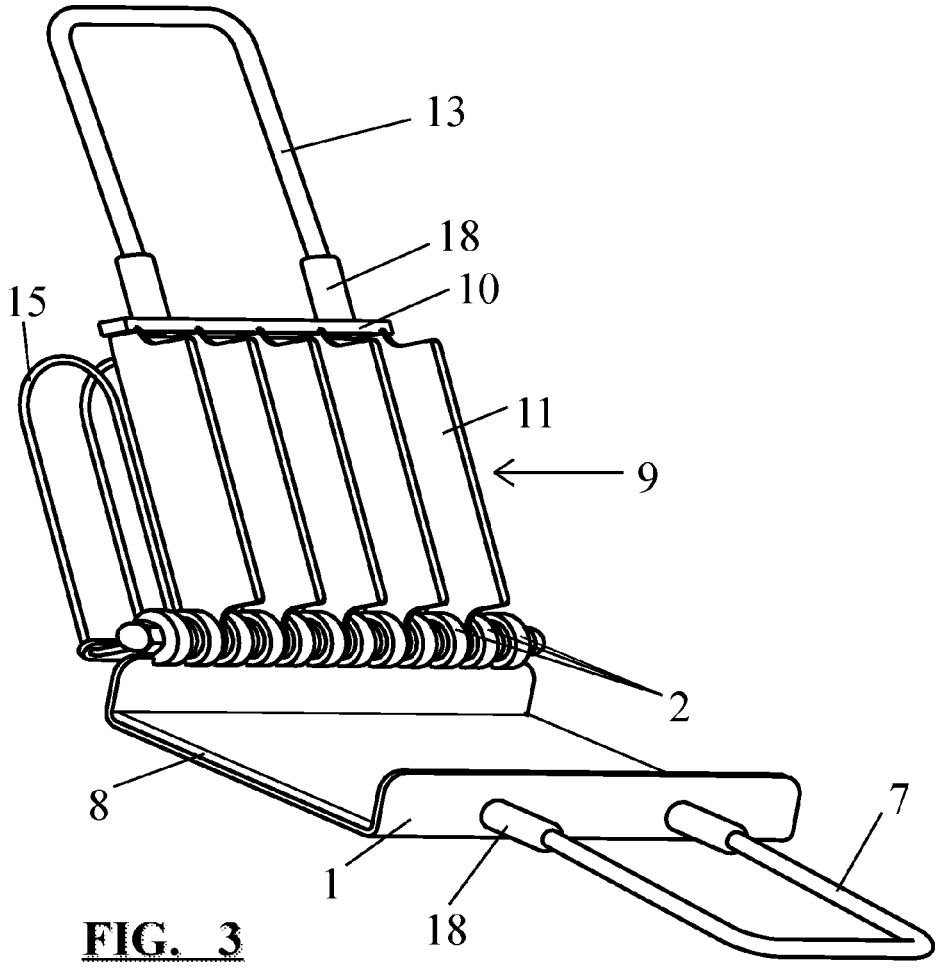

The rolled up crepe is placed on the paper plate and we place it in the open position (FIG. 3) of the bite slicer apparatus mainboard's (1) silicone sheet (8).

Then we swing the knife-unit (9) down using the upper handle (13) until the point it reaches the mainboard (1) and slices the crepe into bites.

After that we close the bite-stabilizer (14) until the D-rings (15) sit on the sliced bites.

At this point the crepe bites become "fixed" to the paper plate.

This is necessary as the 150-180° Celsius hot crepe bites stick in between the blades (11) and they would move together with the knife-unit (9) when it is lifted up. The bite-stabilizer (14) prevents that and the crepe bites remain in perfect shape and in the same position on the paper plate.

After this we move the knife-unit (9) and the bite-stabilizer (14) into the open position and we remove the paper plate with the sliced up crepe which had been placed on the mainboard's (1) silicone sheet (8).

The invention claimed is:

1. The bite slicer apparatus, an apparatus to slice up a crepe on a paper plate, consists of three main parts the mainboard (1) the knife-unit (9) and the bite-stabilizer (14) which comprises the mainboard (1) has been designed in the shape of a U-profile with the lower handle (7) fitted on one side and the bearings (2) fitted on the opposite side, inside the bearings (2) is situated the axis (3), the knife-unit (9) which consists of a number of blades (11) swings 125° on the axis (3), the bite-stabilizer (14) which consists of a number of D-rings (15) swings 160° on the axis (3).

2. The bite slicer apparatus according to claim 1 wherein the knife-unit (9) which is made up of a number of blades (11) alongside each other are set equidistant using spacer rings (6) on one side with each of the blades' boreholes (12) fitted on the axis (3), the other side is connected with the blade connector profile (10).

3. The bite slicer apparatus according to claim 1 wherein the knife-unit's (9) closing to the mainboard (1), is beneficially made to leave a practical gap between an exchangeable, unattached silicon sheet (8), which is placed on the mainboard (1), and the edges of the knife-unit's (9) blades (11).

4. The bite slicer apparatus according to claim 1 wherein the bite-stabilizer (14) which consists of a number of D-rings (15) alongside each other are set equidistant using spacer-rings (6) on one side with the stabilizer-ring (16) fitted on the axis (3), the other side is connected with the D-ring connector profile (17).

5. The bite slicer apparatus according to claim 1 wherein the knife-unit (9) lifts up to 75° at which point the blades' (11) spines hit the bite-stabilizer's (14) D-ring connector profile (17) in its closed position to lift up the bite-stabilizer (14) to its open position.

* * * * *